US011477581B2

(12) United States Patent
Stojanovic et al.

(10) Patent No.: US 11,477,581 B2
(45) Date of Patent: Oct. 18, 2022

(54) MEMS MICROPHONE ASSEMBLY AND METHOD FOR FABRICATING A MEMS MICROPHONE ASSEMBLY

(71) Applicant: ams AG, Premstätten (AT)

(72) Inventors: Goran Stojanovic, Eindhoven (NL); Colin Steele, Eindhoven (NL); Simon Mueller, Eindhoven (NL); Thomas Froehlich, Eindhoven (NL); Erik Jan Lous, Eindhoven (NL); Anderson Pires Singulani, Eindhoven (NL)

(73) Assignee: AMS AG, Premstätten (AT)

( * ) Notice: Subject to any disclaimer, the term of this patent is extended or adjusted under 35 U.S.C. 154(b) by 0 days.

(21) Appl. No.: 17/279,749

(22) PCT Filed: Sep. 17, 2019

(86) PCT No.: PCT/EP2019/074844
§ 371 (c)(1),
(2) Date: Mar. 25, 2021

(87) PCT Pub. No.: WO2020/064428
PCT Pub. Date: Apr. 2, 2020

(65) Prior Publication Data

US 2022/0038825 A1 Feb. 3, 2022

(30) Foreign Application Priority Data

Sep. 26, 2018 (EP) ..... 18196920

(51) Int. Cl.
*H04R 19/04* (2006.01)
*H04R 19/00* (2006.01)
*H04R 31/00* (2006.01)

(52) U.S. Cl.
CPC ..... *H04R 19/04* (2013.01); *H04R 19/005* (2013.01); *H04R 31/003* (2013.01); *H04R 2201/003* (2013.01)

(58) Field of Classification Search
CPC .... H04R 19/04; H04R 19/005; H04R 31/003; H04R 2201/003; H04R 23/008; H04R 31/00; H04R 2499/11
See application file for complete search history.

(56) References Cited

U.S. PATENT DOCUMENTS 9,193,581 B1 11/2015 Chang et al.
9,860,623 B1 * 1/2018 Lee ..... H04R 19/04
(Continued)

FOREIGN PATENT DOCUMENTS

CN 101631739 A 1/2010
CN 105830465 A 8/2016
(Continued)

OTHER PUBLICATIONS

Füldner et al., "Challenges of High SNR (Signal-to-Noise) Silicon Micromachined Microphones", 19th International Congress on Acoustics Madrid, Sep. 2-7, 2007, 6 pages.
(Continued)

*Primary Examiner* — Angelica M McKinney
(74) *Attorney, Agent, or Firm* — MH2 Technology Law Group LLP

(57) ABSTRACT

A micro-electro-mechanical system, MEMS, microphone assembly comprises an enclosure defining a first cavity, and a MEMS microphone arranged inside the first cavity. The microphone comprises a first die with bonding structures and a MEMS diaphragm, and a second die having an application specific integrated circuit, ASIC. The second die is bonded to the bonding structures such that a gap is formed between a first side of the diaphragm and the second die,
(Continued)

with the gap defining a second cavity. The first side of the diaphragm is interfacing with the second cavity and a second side of the diaphragm is interfacing with the environment via an acoustic inlet port of the enclosure. The bonding structures are arranged such that pressure ventilation openings are formed that connect the first cavity and the second cavity.

17 Claims, 5 Drawing Sheets

(56) References Cited

U.S. PATENT DOCUMENTS

| | | | | |
|---|---|---|---|---|
| 2008/0157301 | A1 | 7/2008 | Ramakrishna et al. | |
| 2009/0169035 | A1 | 7/2009 | Rombach et al. | |
| 2012/0280335 | A1* | 11/2012 | Zoellin | H04R 19/04 257/416 |
| 2013/0119492 | A1 | 5/2013 | Feiertag et al. | |
| 2015/0350793 | A1 | 12/2015 | Khenkin et al. | |
| 2016/0007108 | A1* | 1/2016 | Lee | H04R 1/08 381/111 |
| 2017/0230758 | A1 | 8/2017 | Kuntzman et al. | |
| 2020/0058315 | A1* | 2/2020 | Shank | G10L 21/0208 |
| 2020/0059737 | A1* | 2/2020 | Parker | H04R 19/005 |

FOREIGN PATENT DOCUMENTS

| | | | | | |
|---|---|---|---|---|---|
| CN | 106101975 | A | | 11/2016 | |
| CN | 112470492 | A | | 3/2021 | |
| EP | 2252077 | A1 | | 11/2010 | |
| KR | 20070116097 | A | * | 12/2007 | |
| WO | WO-2008048850 | A2 | * | 4/2008 | B81B 3/0027 |
| WO | WO-2014026857 | A1 | * | 2/2014 | B81B 3/0072 |
| WO | 2016091592 | A1 | | 6/2016 | |

OTHER PUBLICATIONS

Kim et al., "Towards a sub 15-dBA optical micromachined microphone", J. Acoust. Soc. Am., vol. 135, No. 5, May 2014, pp. 2664-2673.

Martin, "Design, Fabrication, and Characterization of a MEMS dual-backplate capacitive microphone", Graduate School of the University of Florida, Aug. 2007, 250 pages.

International Search Report and Written Opinion in corresponding International Application No. PCT/EP2019/074844 dated Jan. 21, 2020, 10 pages.

Chinese Search Report in Chinese Application No. 2019800616230 dated Feb. 28, 2022, 7 pages.

Zhao, Zhengping, "MEMS Technology Innovation and Development in the Mobile Internet Era" (with English Abstract), Micro-Nano Electronic Technology, vol. 50, Issue 6, Jun. 2013, pp. 337-341.

Zhou, Juanmin "Design Method of Improving MEMS Microphone Sensitivity"(with English Translation), Integrated Circuit Applications, Nov. 2014, 13 pages.

* cited by examiner

MEMS MICROPHONE ASSEMBLY AND METHOD FOR FABRICATING A MEMS MICROPHONE ASSEMBLY

CROSS-REFERENCE TO RELATED APPLICATIONS

The present application is the national stage entry of International Patent Application No. PCT/EP2019/074844, filed on Sep. 17, 2019, published as WO 2020/064428 A1 on Apr. 2, 2020, which claims benefit of priority of European Patent Application No. 18196920.5 filed on Sep. 26, 2018, all of which are hereby incorporated by reference in their entirety for all purposes.

FIELD OF THE INVENTION

The disclosure relates to a MEMS microphone assembly, in particular based on an optical MEMS microphone, and a method for fabricating a MEMS microphone assembly.

BACKGROUND OF THE INVENTION

Micro-electro-mechanical systems, MEMS, microphones are used in a wide range of audio applications in modern consumer electronics. Common examples in which integrated MEMS microphones play an important role are portable computing devices such as laptops, notebooks and tablet computers, but also portable communication devices like smartphones or smartwatches. Due to increasing space constraints of these devices, components are becoming more and more compact and are decreasing in size. As this also applies to MEMS microphones employed in these devices, they have become highly integrated components with sophisticated package designs and are characterized by a small size, high sound quality, reliability and affordability.

SUMMARY

This disclosure provides an improved concept for a compact MEMS microphone assembly with reduced size and high sensitivity.

The improved concept is based on the idea of providing a MEMS microphone assembly, which has an increased effective back volume. A large back volume is tantamount to a larger acoustic capacitance of the air behind the MEMS diaphragm inside the microphone assembly leading to a reduction of the acoustic impedance, which is induced by the limited compressibility of the air inside the back volume. Supplementary aspects of the improved concept aim for a further reduction of the acoustic impedance due to an improved airflow between the diaphragm and the application-specific integrated circuit, ASIC, which is typically arranged in close vicinity to the diaphragm and serves the purpose of reading out movements, i.e. deflections of the MEMS diaphragm. The MEMS diaphragm is a membrane, for example.

In particular, a MEMS microphone assembly of the improved concept comprises an enclosure which defines a first cavity and has an acoustic inlet port connecting the first cavity to an environment of the assembly. Arranged inside the first cavity, the assembly further comprises a MEMS microphone that has a first die with bonding structures and a MEMS diaphragm, wherein the diaphragm has a first side and a second side, and a second die having an application-specific integrated circuit, ASIC.

According to the improved concept, the second die is bonded to the bonding structures of the first die such that a gap is formed between the first side of the diaphragm and the second die, wherein the gap defines a second cavity and has a gap height. The bonding may be of an adhesive or an eutectic nature according to standard wafer bonding processes, for example. In such an assembly, the first side of the diaphragm is interfacing with the second cavity and the second side of the diaphragm is interfacing with the environment via the acoustic inlet. Additionally, the bonding structures are arranged such that pressure ventilation openings are formed that connect the first cavity and the second cavity.

In such a MEMS microphone assembly, the back volume that is typically defined by the gap between the MEMS diaphragm and the ASIC is connected via the pressure ventilation openings to the volume of the first cavity defined by the enclosure, which typically serves for packaging purposes. This has the effect that a compression of the air within the gap due to a moving diaphragm, for example, is distributed across a significantly larger amount of air, hence increasing its acoustic compliance.

As modern MEMS microphones continue to decrease in size, their back volumes also decrease which leads to potentially larger acoustic impedance. This in turn entails a deterioration of the audio performance of the microphone with respect to sensitivity, frequency response and signal-to-noise ratio, SNR, for instance. An increase of the back volume therefore aims at reducing the acoustic impedance and thereby overcomes the limitations of existing MEMS microphone devices.

Having the pressure ventilation openings defined by the bonding structures of the MEMS die eliminates the need for alternative solutions, such as ventilation openings through the ASIC die for instance, that would imply a limitation on the space for electrical components of the ASIC.

Besides defining the first cavity, the enclosure according to the improved concept serves the additional purpose of making the mems microphone omnidirectional for sound waves entering the assembly through the acoustic inlet port. To this end, the first die is arranged with respect to the acoustic inlet port such that the first cavity and the second cavity are hermetically sealed from the environment at boundaries of the acoustic inlet port. For example, the diaphragm is flush-mounted with respect to the acoustic inlet port.

The assembly may further comprise connections from the ASIC to external circuits, for example via wiring and/or feedthroughs through the enclosure.

In some embodiments, the gap height is larger than 10 μm, in particular equal to or larger than 50 μm.

Conventional MEMS microphones typically have gap heights of 10 μm or less. For capacitive microphones, the gap height needs to be as small as 2 μm in order to still possess sufficient signal-to-noise ratios by achieving required capacitances. Optical microphones that rely on the optical detection of diffraction phenomena from a grating integrated in the MEMS diaphragm, for example, are likewise characterized by gap heights of less than 10 μm. Therefore the small amount of air located in the gap exerts a large impedance onto the motion of the diaphragm when the air is compressed due to deflections of the diaphragm that reduce the gap height. This squeezed impedance may be the limiting factor in the signal-to-noise ratio of a MEMS microphone.

Increasing the gap height to values significantly above 10 μm, as suggested by the improved concept, means a larger amount of air inside the gap, which leads to a distribution of compression and therefore to an overall smaller squeeze impedance that destructively acts on the deflections of the MEMS diaphragm.

The readout of the diaphragm deflection in these embodiments is optionally realized via an optical deflection measurement scheme, such as a beam-deflection measurement known from atomic force microscopy, or via an optical interferometric measurement. In particular for these measurement schemes, the MEMS diaphragm including its surfaces is not required to be perforated, patterned, structured or the like for readout purposes, but may be a diaphragm with plain top and bottom surfaces across its entire surface area.

In some embodiments, the pressure ventilation openings are defined by voids between clamping structures of the diaphragm and the bonding structures in a main extension plane of the diaphragm.

In such an embodiment, a clamping structure that suspends the MEMS diaphragm and may in addition serve a structure for mounting the MEMS microphone to the acoustic inlet port of the enclosure, is connected to the bonding structures such that gaps are defined. For example, a circular diaphragm may be suspended by an annular clamping structure at a boundary of the diaphragm and the clamping structure may be connected in the plane of the diaphragm to a concentric but larger annular bonding structure by means of a number of bridges. Voids between the bridges define the gaps that serve as the pressure ventilation openings.

In some alternative embodiments, the pressure ventilation openings are defined by voids of the bonding structures.

Alternatively to the above-mentioned embodiments, voids in the bonding structures may instead serve as the pressure ventilation openings. For the example of a circular diaphragm with an annular clamping structure, bonding structures may be arranged on a bottom side of the clamping structure in certain points. In this way, the pressure ventilation openings are located between the plane of the diaphragm and the top surface of the ASIC die after bonding.

In some embodiments, the second die comprises a ventilation hole that connects the first cavity and the second cavity.

If permitted by an arrangement of electric components of the ASIC, one or more ventilation holes may be integrated into the ASIC die for providing additional connections between the first and the second cavity. This may further improve the airflow and hence reduce the acoustic impedance, particularly for devices with small airgaps. For devices with airgaps large enough, i.e. larger than 50 μm, these additional ventilation holes in the ASIC die only cause, if at all, an insignificant reduction of the acoustic impedance and may therefore not be necessary.

In some embodiments, at least one dimension of the pressure ventilation openings corresponds to the gap height.

Designing the pressure ventilation openings such that their height equals the gap height, for example, enables a maximum improvement of the airflow and connection of the first and the second cavity.

In some embodiments, the MEMS microphone consists of the first die and the second die.

The MEMS microphone consisting of only two dies, namely a first die for the MEMS diaphragm and a second die for the ASIC allows for cost and yield efficient separate fabrication according to a MEMS-compatible process for the first die, and an ASIC-compatible process for the second die. In contrast, conventional microphones typically employ a more complicated three-die structure, wherein a third die acts as a connecting link between the first and the second die. Moreover, a two die structure can be chosen over a single-die structure as the latter requires consideration of both a MEMS and an ASIC compatible fabrication process at the same time.

In a final step of the fabrication, the two dies are bonded together with a gap between the MEMS diaphragm and a top surface of the ASIC die. The bonding may be performed according to standard wafer level bonding techniques. In particular, the bonding structures of the first die are bonded to bonding pads on the second die, for example, such that the die are bonded only at specific points for defining the pressure ventilation openings.

In particular, no additional die, for example comprising a back plate, for instance a perforated backplate, is required, ensuring a compact assembly even for large gap heights.

In some embodiments, the assembly further comprises an optical readout assembly having at least a light source and a detector, wherein the optical readout assembly is configured to detect a displacement of a point or a surface of the diaphragm, in particular a point or a surface of the first side of the diaphragm.

Conventional MEMS microphones that employ capacitive readout schemes or optical readout schemes based on diffraction phenomena have the limitation of very small gap heights, as mentioned above, in order to be able to detect any deflection of the diaphragm in the first place. On the contrary, employing an optical deflection measurement scheme such as a beam-deflection measurement commonly used in atomic force microscopy or an interferometric measurement, which both aim at optically measuring deflections of a point or a surface of the diaphragm with high sensitivity, allows to use larger gap heights that lead to a decrease in acoustic impedance influencing the movement of the diaphragm. In these embodiments, the ASIC may comprise a coherent light source such as a laser and illuminates a certain spot or a certain surface on the first side of the diaphragm facing the ASIC. The deflection of the diaphragm may consequently be read out by an optical detector of the ASIC, for example a segmented photodiode or a detector configured to compare the reflected light with that of a reference beam reflected from a static point or surface of the assembly in case of an interferometric measurement scheme.

In some embodiments, the enclosure comprises a pressure equalization opening.

Alternatively, in some embodiments the diaphragm further comprises a pressure equalization opening.

Static air pressure levels typically fluctuate by several tens of hPa around the standard atmosphere level of 1,013 hPa at sea level. As sound pressure levels are in the order of 1 Pa and can be as small as 20 μPa, which is considered the threshold for human hearing, equal pressure levels in the environment and inside the microphone assembly are absolutely essential for the detection of small pressure fluctuations due to a soundwave, for instance. In order to ensure the equality between the static pressure in the back volume, defined by the first and the second cavity, and that of the environment, the microphone assembly comprises a pressure equalization vent in these embodiments. This vent can, for example, be defined by an pressure equalization opening either located in the enclosure or in the MEMS diaphragm.

In some further embodiments, the pressure equalization opening is configured to act as a high pass filter for longitudinal waves, in particular as a high pass filter with a cut-off between 20 Hz and 100 Hz.

As microphones are typically used to sense longitudinal waves in the audio band that covers frequencies from 20 Hz to 20 KHz, a band pass filter in this frequency band is desirable. While the upper cut-off frequency is typically determined by mechanical resonances of the MEMS diaphragm, properties of the enclosure, in particular the size and acoustic capacitance of the enclosed back volume, and the acoustic capacitance of the pressure equalization opening determine the lower cut-off frequency of the microphone. To achieve the desired high pass filter with a cut-off in the order of Hz, the size of the pressure ventilation opening in these embodiments of the microphone assembly with a given enclosure is typically in the order of 1 μm to 10 μm.

The object is further solved by an electronic device, such as a pressure sensing device or a communication device, comprising a MEMS microphone assembly according to one of the embodiments described above, wherein the MEMS microphone is configured to omnidirectionally detect dynamic pressure changes in the environment, in particular dynamic pressure changes at rates corresponding to audio frequencies.

A MEMS microphone assembly according to one of the embodiments described above may be conveniently employed in various applications that require a compact high sensitivity sensor for detecting small dynamic pressure changes, particularly in the audio band for the detection of sound waves. Therefore, the present disclosure is meant to be employed in portable computing devices such as laptops, notebooks and tablet computers, but also in portable communication devices like smartphones, smart watches and headphones, in which space for additional components is extremely limited.

Applications that do not necessarily focus on the audio band are sensor devices configured to detect pressure waves caused by vibrations at various frequencies. Examples for such applications are seismic sensors and sensor devices for monitoring vibrations of various surfaces via near-field sensing. For example, a MEMS microphone is attached to a surface of an electric motor for monitoring its vibrations and provide a measurement signal to a controller of the electric motor for adjustment of its operation.

The object is further solved by a method of fabricating a micro-electro-mechanical system, MEMS, microphone assembly. The method comprises providing an enclosure that defines a first cavity, wherein the enclosure comprises an acoustic inlet port that connects the first cavity to an environment of the assembly. The method further comprises arranging a first die and a second die of a MEMS microphone inside the first cavity, wherein the first die comprises a MEMS diaphragm and bonding structures, and the second die comprises an application-specific integrated circuit, ASIC. According to the method, the second die is bonded to the bonding structures of the first die such that a gap is formed between the diaphragm and the second die, wherein the gap defines a second cavity and has a gap height. Moreover, the first die is arranged such that a first side of the diaphragm is interfacing with the second cavity and a second side of the diaphragm is interfacing with the environment via the acoustic inlet port. The bonding structures are arranged such that pressure ventilation openings are formed that connect the first cavity and the second cavity.

Further embodiments of the method become apparent to the skilled reader from the embodiments of the microphone assembly described above.

BRIEF DESCRIPTION OF THE DRAWINGS

The following description of figures of example embodiments may further illustrate and explain aspects of the improved concept. Components and parts of the microphone assembly with the same structure and the same effect, respectively, appear with equivalent reference symbols. In so far as components and parts of the microphone assembly correspond to one another in terms of their function in different figures, the description thereof is not repeated for each of the following figures.

DETAILED DESCRIPTION

Figure 1:
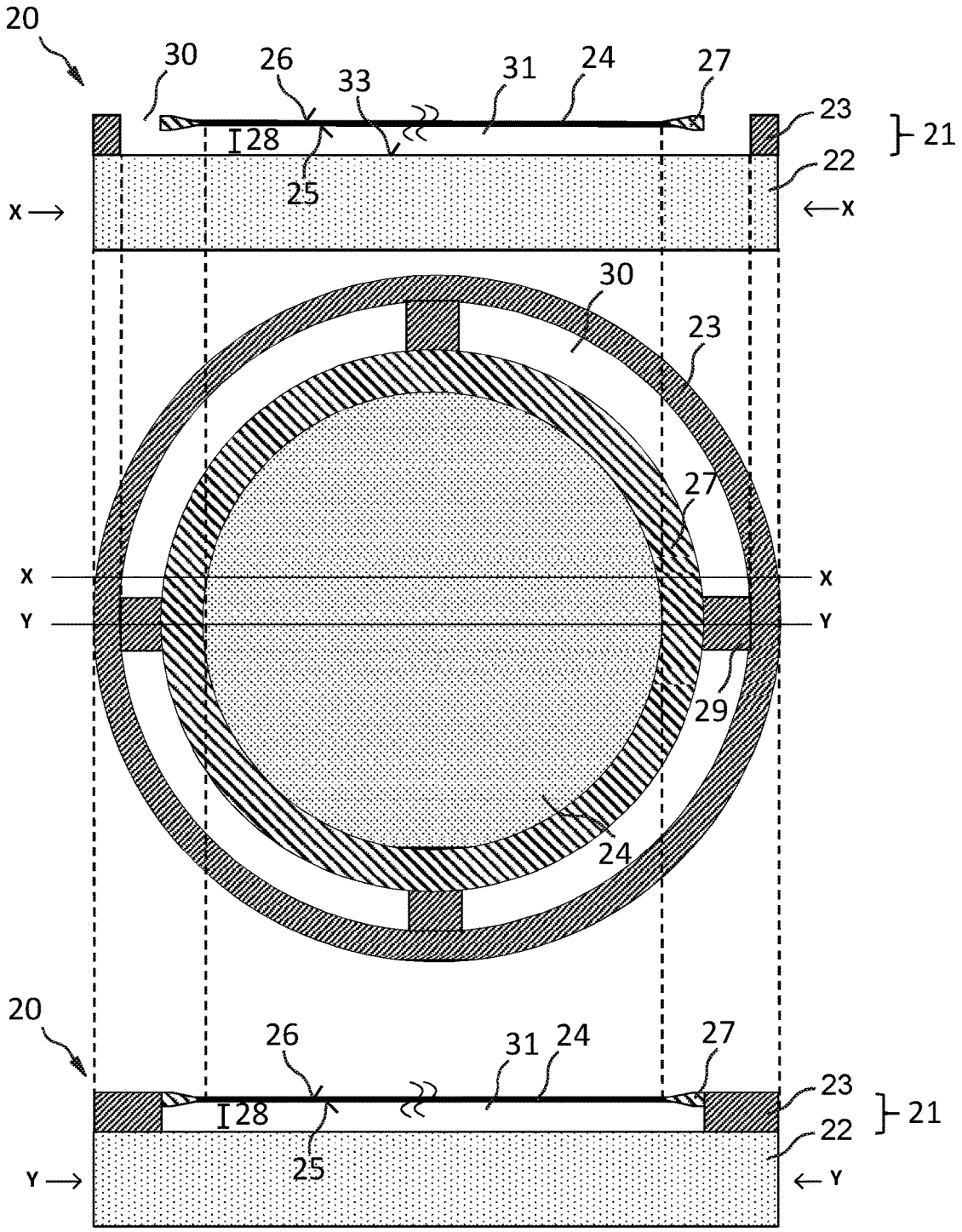
FIG. 1 shows an exemplary embodiment of the MEMS microphone of the MEMS microphone assembly according to the improved concept.

FIG. 1 shows an exemplary embodiment of the MEMS microphone 20 of the MEMS microphone assembly 1 according to the improved concept. In particular, FIG. 1 shows the microphone 20 in a top view in the center and two cross section views at the virtual cuts x and y on the top and on the bottom, respectively.

The MEMS microphone 20 comprises a first die 21 that is bonded via an annular bonding structure 23 on the first die 21 to a second die 22. Besides the bonding structure 23 the first die 21 comprises a MEMS diaphragm 24, in this example of circular shape, which is suspended and clamped to an annular clamping structure 27. A typical diameter for a diaphragm configured to be sensitive to sound waves is in the order of 0.5 mm to 1.5 mm. The clamping structure 27 is at certain points connected to the bonding structure 23 via bridges 29, in this example via four bridges 29 that are evenly arranged around the perimeter of the clamping structure 27, such that pressure ventilation openings 30 are defined by voids formed by the bridges 29, the clamping structure 27 and the bonding structure 23. In this embodiment, the pressure ventilation openings 30 are thus located in the main extension plane of the diaphragm 24 and connect the second cavity 31 to the first cavity 11 defined by the enclosure 10, which is not shown in this figure. The MEMS diaphragm 24 may be made of silicon nitride and the clamping structure 27, the bonding structure 23 and the bridges 29 may be made of the same material, for example silicon, or of different materials.

The first die 21 is bonded to the second die 22 via standard wafer bonding techniques, which may be of an adhesive or an eutectic type, for instance. The second die 22 comprises besides an application-specific integrated circuit, ASIC, bonding pads, for example, that optionally correspond to the bonding structure 23 of the first die 21 with respect to size, shape and position. The bonding is performed such that a gap 28 is formed between a first side 25 of the diaphragm 24 and a top surface 33 of the second die 22, wherein the gap defines the second cavity 31. The gap height is larger than 10 μm, in particular equal to or larger than 50 μm. A width of the pressure ventilation openings 30 typically is of similar dimension.

The ASIC on the second die 22 is configured to measure a movement of the diaphragm 24, for example a periodical deflection due to an oscillation of the diaphragm 24. If the microphone is an optical microphone, the ASIC may for example comprise a coherent light source such as a laser that is configured to illuminate a point or a surface on the first side 25 of the diaphragm 24. The ASIC may further comprise a detector that is configured to detect light from the light source that is reflected from the point or the surface on the first side 25 of the diaphragm 24 and to generate an electrical signal based on the detected light. The detector may be a segmented photodiode, for instance. The ASIC may further comprise a processing unit that is configured to map the electric signal to a deflection signal and to output the signal to an output port. Alternatively, the ASIC may be configured to output the electric signal to an external processing unit via an output port.

Figure 2:
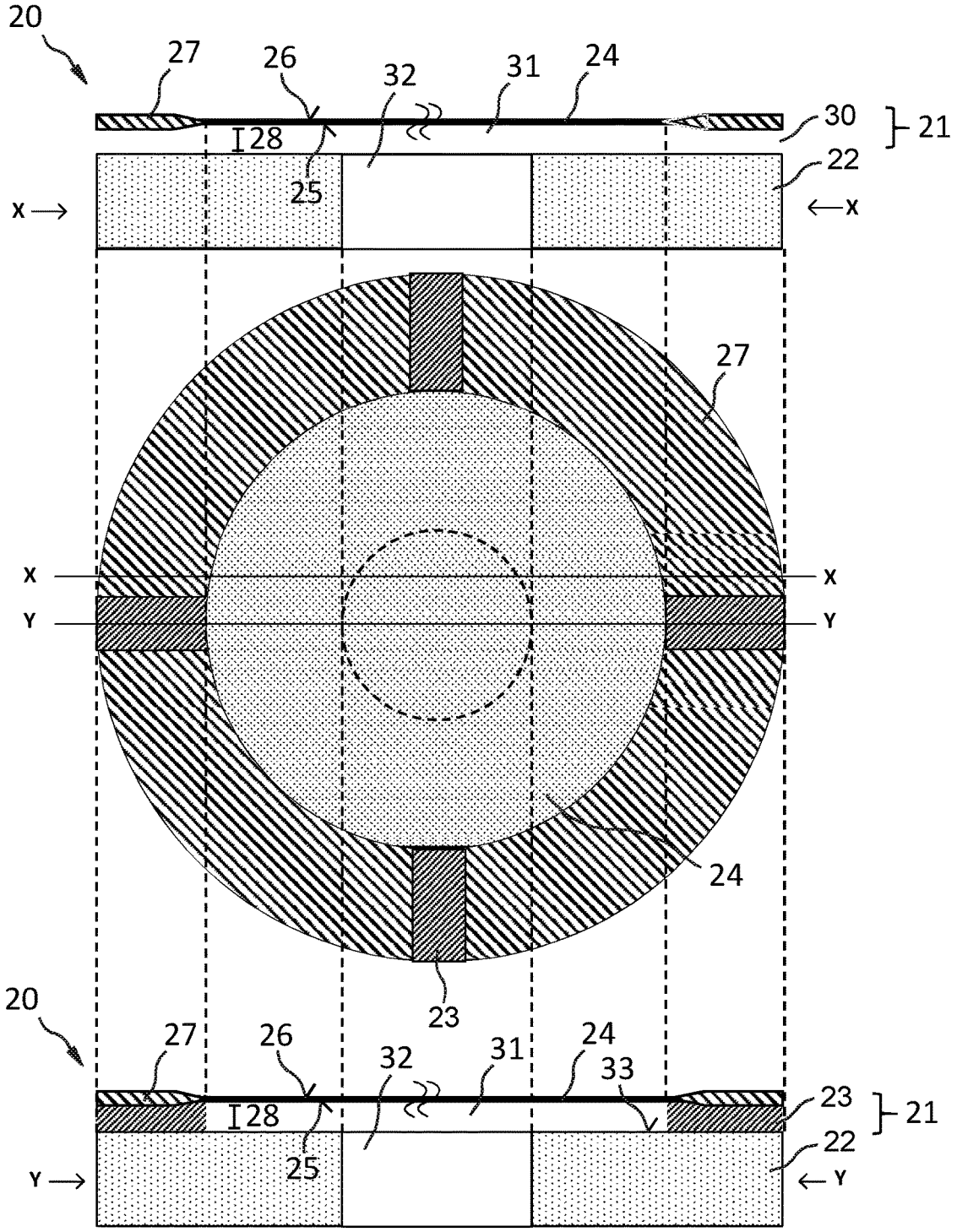
FIG. 2 shows a further exemplary embodiment of the MEMS microphone of the MEMS microphone assembly according to the improved concept.

FIG. 2 shows a further exemplary embodiment of the MEMS microphone 20 of the MEMS microphone assembly 1 according to the improved concept. The embodiment is based on that shown in FIG. 1. Similarly, FIG. 2 shows the microphone 20 in a top view in the center and two cross section views at the virtual cuts x and y on the top and on the bottom, respectively.

In contrast to the embodiment shown in FIG. 1, here the bonding structures 23 are arranged in between the clamping structure 27 of the diaphragm 24 and the top surface 33 of the second die 22. In this example, the bonding structures 23 are defined solely by bridges evenly arranged around the perimeter of the diaphragm 24. This way, the pressure ventilation openings 30 are defined after bonding of the first die 21 and the second die 22. In particular, voids of the bonding structures 23 around the perimeter of the diaphragm 24 define the pressure ventilation openings to be arranged in between the clamping structure 27 and the top surface of the second die 22 and corresponding with respect to their height to the gap height, which likewise is larger than 10 μm, in particular equal to or larger than 50 μm.

In addition, in this embodiment the second die 22 further comprises an optional ventilation hole 32 that, like the pressure ventilation openings 30 connect the second cavity 31 to the first cavity 11 defined by the enclosure 10 not shown.

Figure 3:
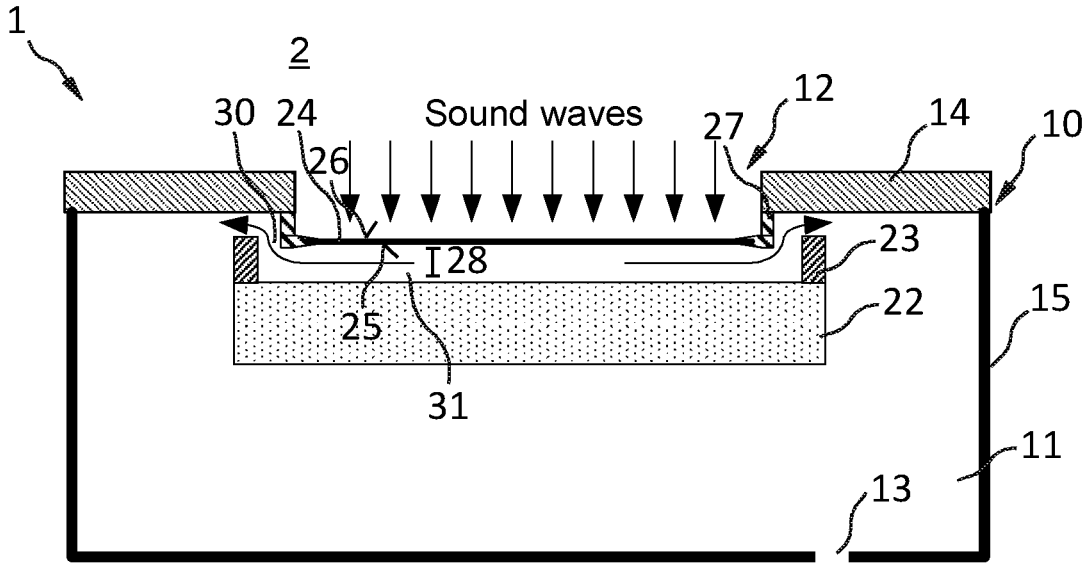
FIG. 3 shows an exemplary embodiment of the MEMS microphone assembly according to the improved concept.

FIG. 3 shows an exemplary MEMS microphone assembly 1 according to the improved concept. The assembly comprises an enclosure 10 that defines a first cavity 11 as its enclosed volume. The enclosure 10 comprises sidewalls 15 and a PCB board 14 that has an opening as an acoustic inlet port 12 for incoming pressure waves such as sound waves, making this microphone assembly 1 a bottom port microphone assembly. The enclosure in this embodiment further comprises a pressure equalization opening 13 connecting the first cavity 11 to the environment 2, for example an environment 2 of a gas such as air, for ensuring an equal pressure of the environment 2 and the first cavity 11. With this equalization opening 13, changes in the static pressure of the environment 2 propagate into the microphone assembly allowing for an invariable sensitivity for dynamic pressure changes, such as sound waves.

The dimension of the equalization opening 13 is in the order of 1 μm to 10 μm, therefore acting as a high pass filter for the microphone assembly 1 with a cut-off frequency of typically 20-100 Hz for acoustic microphone configurations. The upper cut-off frequency of the microphone assembly is typically defined my mechanical resonances of the MEMS diaphragm 24 and is typically around 20 kHz.

The enclosure 10 may be formed by a third die comprising the PCB board 14 and the sidewalls 15 but may alternatively be formed by a generic housing, for example of a metal or a polymer. The PCB board 14 may comprise electrical contacts t output a microphone signal to an external processing unit such as a microprocessor of an electronic device.

Inside the enclosure 10, i.e. inside the first cavity 11, a MEMS microphone 20, for example according to one of the embodiments described above, is arranged with respect to the acoustic inlet port 12 such that the first cavity 11 is hermetically sealed from the environment 2 at boundaries of the acoustic inlet port 12. For example, the clamping structures 27 are mounted to the PCB board 14 such that the MEMS diaphragm 24 of the microphone 20 is flush-mounted with the acoustic inlet port 12. This way, the microphone assembly 1 becomes omnidirectional, i.e. sensitive to sound waves entering the acoustic inlet port 12 at different incident angles as incident pressure waves can only impinge on the second side 26 of the diaphragm 24 and not enter the first cavity 11 or the second cavity 31 and destructively influence deflection or motion of the diaphragm 24 via its first side 25.

The diaphragm 24, the clamping structures 27, the bonding structures 23 and the second die 22 with the ASIC for detection of a deflection of the diaphragm 24 define the second cavity 31 via the gap 28. Pressure ventilation openings 30 connect the first cavity 11 and the second cavity 22, significantly increasing the back volume of the MEMS microphone 20. This increase ensures a reduced acoustic impedance that destructively influences the motion of the diaphragm 24 and thus reduces the signal-to-noise ratio of the detected sound waves. The increase is due to the fact that an increased air pressure due to compression is distributed via the pressure ventilation openings 30 across the entire volume of the microphone assembly 1 defined by the first cavity 11 and the second cavity 31. The arrows inside the microphone assembly 1 represent an air pressure flow in case of a motion of the diaphragm 24 towards the second die 22.

For readout, an output port of the ASIC on the second die 22 may be electrically connected to contacts on the side of the PCB board 14 facing the environment 2, for example via feedthroughs.

The combination of the large gap 28, the large back volume due to the pressure ventilation openings 30 and the pressure equalization opening 13 enable a low noise due to acoustic impedance, i.e. a high sensitivity of the microphone assembly for sound pressures in the order of 200 μPa, which is only one order of magnitude above the human hearing threshold and corresponds to a sound pressure level, SPL, of 19 dB.

Figure 4:
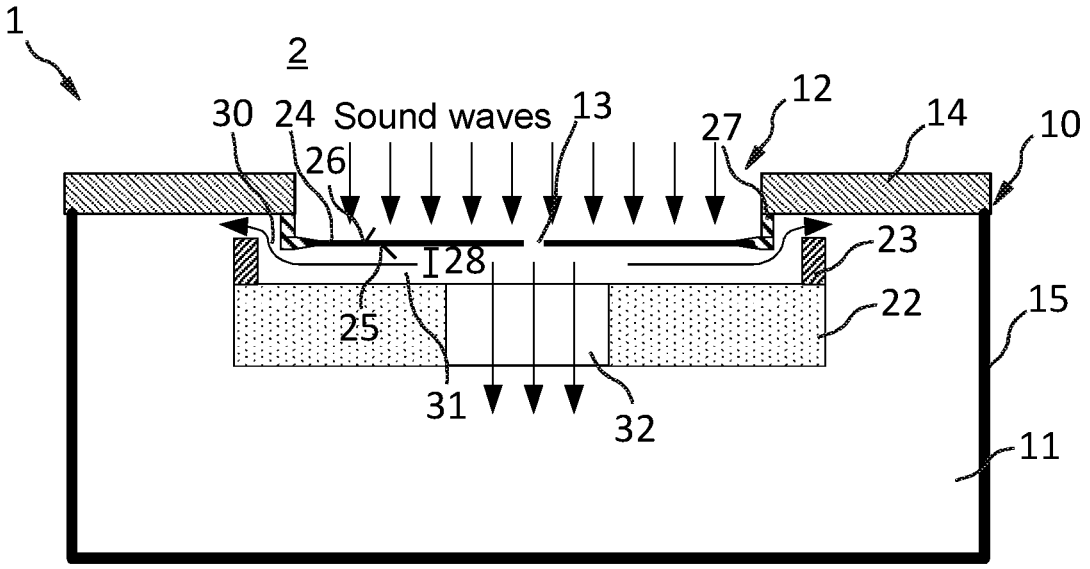
FIG. 4 shows a further exemplary embodiment of the MEMS microphone assembly according to the improved concept.

FIG. 4 shows a further exemplary MEMS microphone assembly 1 according to the improved concept. In comparison to FIG. 3, this embodiment is characterized by an alternative position of the pressure equalization opening 13 in the middle of the diaphragm 24. Although the fundamental vibrational mode, i.e. the trampoline mode, of the diaphragm 24 has its maximum deflection at this point and a measurement would therefore yield the highest signal-to-noise ratio, in general higher order modes of the diaphragm are of higher relevance as these lie in the band of interest with respect to their frequencies. The optimum measurement points, i.e. the antinodes of these higher order modes, are not necessarily in the center of the diaphragm 24.

In addition, the embodiment shown in addition to the pressure ventilation openings 30 comprises an optional ventilation hole 32 in the second die 22 serving as additional connection between the first cavity 11 and the second cavity 31, which potentially further decreases the acoustic impedance. Again, the arrows inside the microphone assembly 1 represent an air pressure flow in case of a motion of the diaphragm 24 towards the second die 22.

Figure 5:
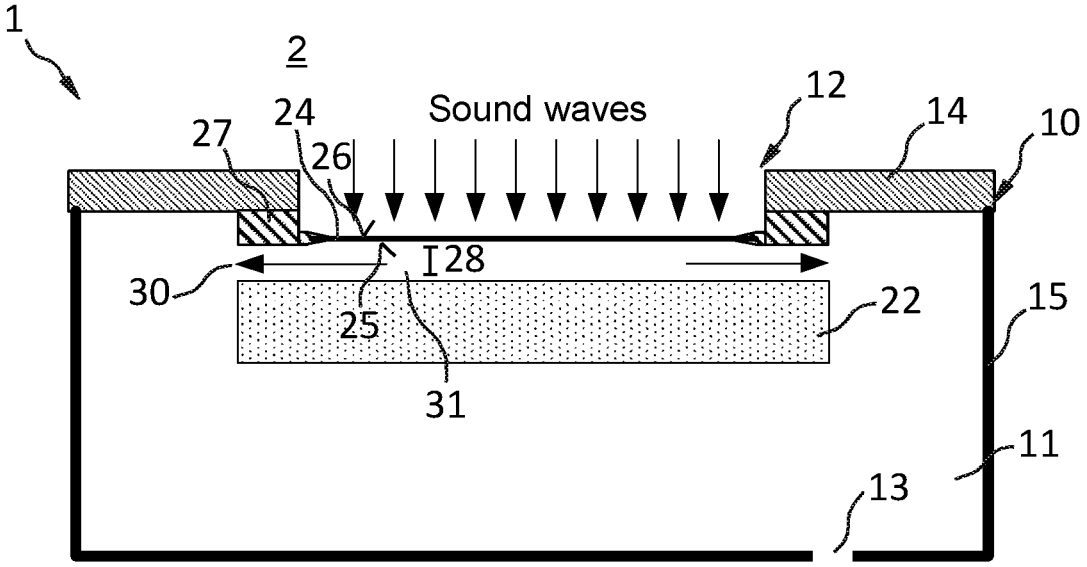
FIG. 5 shows a further exemplary embodiment of the MEMS microphone assembly according to the improved concept.

FIG. 5 shows a further exemplary MEMS microphone assembly 1 according to the improved concept. This embodiment comprises a microphone 20 according to the embodiment shown in FIG. 2. In particular, the pressure ventilation openings are here arranged between the clamping structures 27 and the second die 22 and correspond in height to the gap height of the gap 28. Compared to the embodiments shown in FIGS. 3 and 4, this embodiment is characterized by an even lower noise level, i.e. a higher sensitivity, capable to operate at a sound pressure level approximately 0.5 dB lower at 18.5 dB.

Figure 6:
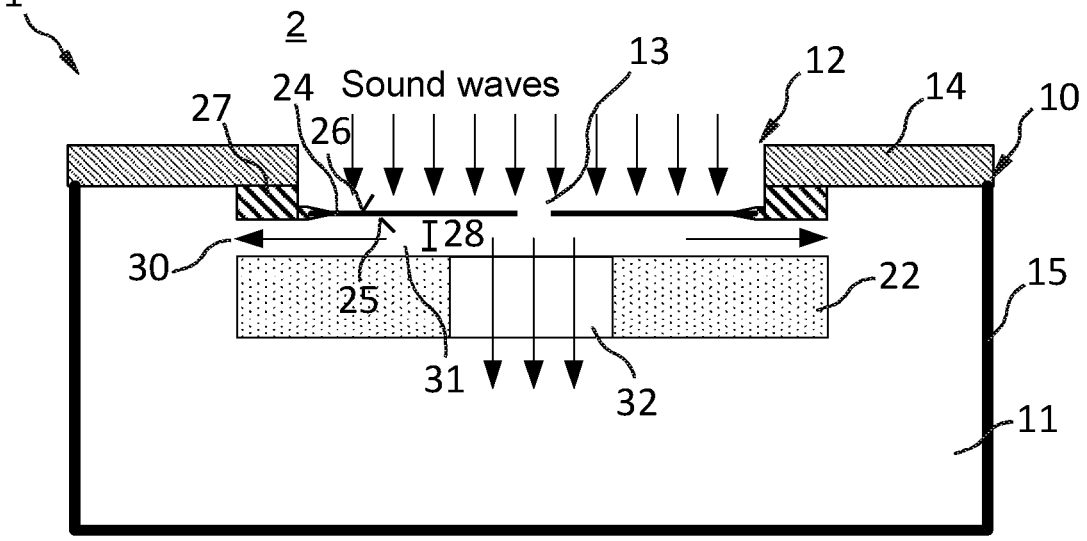
FIG. 6 shows a further exemplary embodiment of the MEMS microphone assembly according to the improved concept.

Similar to the embodiment shown in FIG. 4, the embodiment in FIG. 6 features the optional ventilation hole 32 as well as the pressure equalization opening 13 located in the diaphragm 24.

Figure 7:
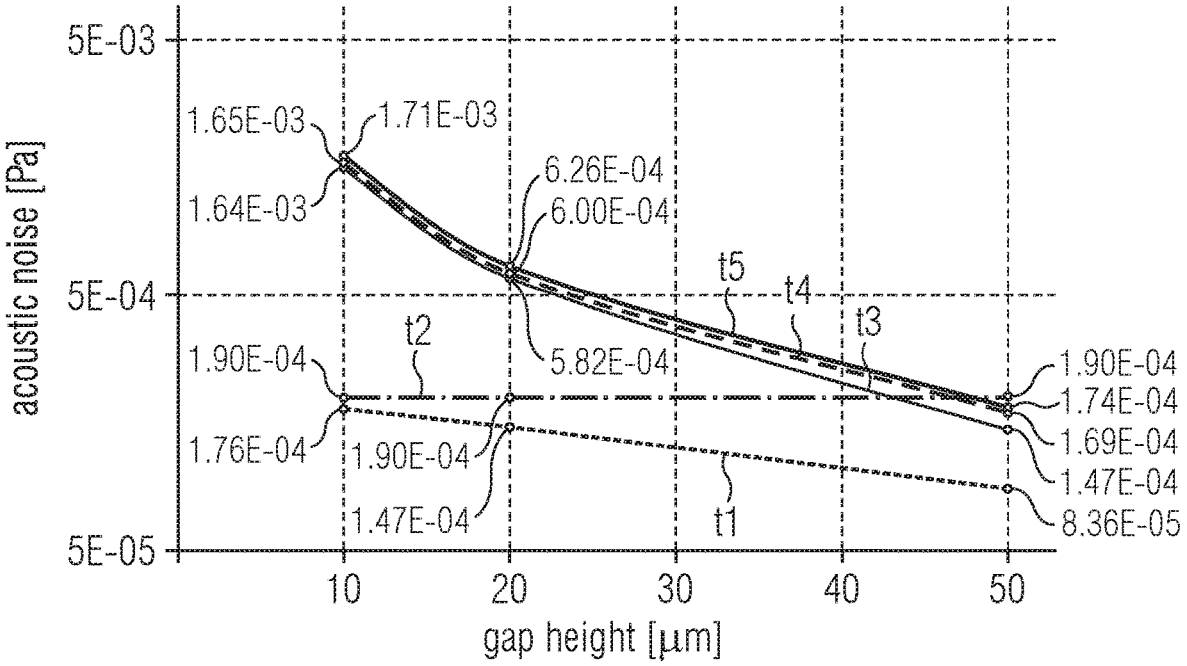
FIG. 7 shows acoustic noise characteristics of the embodiment of the MEMS microphone assembly shown in FIG. 5.

FIG. 7 shows simulated acoustic noise of the microphone assembly 1 shown in FIG. 5 in dependence of the gap height of the gap 28. The different traces t1-t3 show different noise contributions, while traces t4 and t5 show the effective total noise.

In particular, t3 shows the acoustic noise due to compression, or squeezing, of air in the second cavity 31 due to a deflection of the diaphragm. Traces t1 and t2 represent acoustic noise due to a present opening 32 in the second die 22 with and without the pressure ventilation openings 30, respectively. Traces t4 and t5 constitute the total acoustic noise of embodiments of the microphone assembly 1 without and with opening 32 in the second die 22, respectively.

Particularly for gap heights of 50 μm or larger, the opening 32 only has an insignificant contribution to the total noise level and is therefore obsolete leaving space for additional components of the ASIC, for example. The noise level of this particular embodiment is found to be 174 μPa, indicating that the minimum detectable sound pressure level for a gap height of 50 μm is 18.8 dB for this particular exemplary embodiment.

The embodiments shown in the FIGS. 1 to 6 as stated represent exemplary embodiments of the microphone 20 and the microphone assembly 1, therefore they do not constitute a complete list of all embodiments according to the improved concept. Actual microphone and microphone assembly configurations may vary from the embodiments shown in terms of shape, size and materials, for example. For instance, the microphone assembly 1 may be configured to be a front port microphone assembly, which may be beneficial for some applications.

A MEMS microphone assembly according to one of the embodiments shown may be conveniently employed in various applications that require a compact high sensitivity sensor for detecting small dynamic pressure changes, particularly in the audio band for the detection of sound waves. Possible applications include an employment as an acoustic microphone in computing devices such as laptops, notebooks and tablet computers, but also in portable communication devices like smartphones and smart watches, in which space for additional components is extremely limited.

The invention claimed is:

1. A micro-electro-mechanical system, MEMS, microphone assembly comprising:

an enclosure defining a first cavity, the enclosure comprising an acoustic inlet port that connects the first cavity to an environment of the assembly; and a MEMS microphone arranged inside the first cavity, the microphone comprising a first die with bonding structures and a MEMS diaphragm, the diaphragm having a first side and a second side, and a second die having an application specific integrated circuit, ASIC;

wherein the second die is bonded to the bonding structures of the first die such that a gap is formed between the first side of the diaphragm and the second die, with the gap defining a second cavity and having a gap height;

the first side of the diaphragm is interfacing with the second cavity and the second side of the diaphragm is interfacing with the environment via the acoustic inlet port; and the bonding structures are arranged such that pressure ventilation openings are formed that connect the first cavity and the second cavity; and the gap height is larger than 10 μm.

2. The MEMS microphone assembly according to claim 1, wherein the pressure ventilation openings are defined by voids between clamping structures of the diaphragm and the bonding structures in a main extension plane of the diaphragm; or voids of the bonding structures.

3. The MEMS microphone assembly according to claim 1, wherein the second die comprises an opening that connects the first cavity and the second cavity.

4. The MEMS microphone assembly according to claim 1, wherein at least one dimension of the pressure ventilation openings corresponds to the gap height.

5. The MEMS microphone assembly according to claim 1, wherein the MEMS microphone consists of the first die and the second die.

6. The MEMS microphone assembly according to claim 1, further comprising an optical readout assembly having at least a light source and a detector, wherein the optical readout assembly is configured to detect a displacement of a point or a surface of the diaphragm, in particular a point or a surface of the first side of the diaphragm.

7. The MEMS microphone assembly according to claim 1, wherein the enclosure comprises a pressure equalization opening.

8. The MEMS microphone assembly according to claim 7, wherein the pressure equalization opening is configured to act as a high-pass filter for longitudinal waves, in particular as a high-pass filter with a cut-off frequency between 20 Hz and 100 Hz.

9. The MEMS microphone assembly according to claim 7, wherein the pressure equalization opening is configured to act as a high-pass filter with a cut-off frequency between 20 Hz and 100 Hz.

10. The MEMS microphone assembly according to claim 1, wherein the diaphragm further comprises a pressure equalization opening.

11. The MEMS microphone assembly according to claim 10, wherein the pressure equalization opening is configured to act as a high-pass filter for longitudinal waves.

12. An electronic device, such as a pressure sensing device or a communication device, comprising the MEMS microphone assembly according to claim 1, wherein the MEMS microphone assembly is configured to omnidirectionally detect dynamic pressure changes in the environment, in particular dynamic pressure changes at rates corresponding to audio frequencies.

13. The MEMS microphone assembly according to claim 1, wherein the MEMS microphone assembly is free of a back plate.

14. The MEMS microphone assembly according to claim 1, wherein the gap height is larger than 50 μm.

15. A method of fabricating a micro-electro-mechanical system, MEMS, microphone assembly, the method comprising:

providing an enclosure defining a first cavity, the enclosure comprising an acoustic inlet port that connects the first cavity to an environment of the assembly;

arranging a first die of a MEMS microphone inside the first cavity, the first die comprising a MEMS diaphragm and bonding structures; and arranging a second die of the MEMS microphone inside the first cavity, the second die comprising an application specific integrated circuit, ASIC;

wherein the second die is bonded to the bonding structures such that a gap is formed between the diaphragm and the second die, with the gap defining a second cavity and having a gap height;

a first side of the diaphragm is interfacing with the second cavity and a second side of the diaphragm is interfacing with the environment via the acoustic inlet port;

the bonding structures are arranged such that pressure ventilation openings are formed that connect the first cavity and the second cavity; and the gap height is larger than 10 μm.

16. The method according to claim 15, wherein the first die is arranged with respect to the acoustic inlet port such that the first cavity is hermetically sealed from the environment at boundaries of the acoustic inlet port.

17. The method according to claim 15, wherein the pressure ventilation openings are defined by voids between clamping structures of the first die and the bonding structures in a main extension plane of the diaphragm; or voids of the bonding structures.

* * * * *